United States Patent [19]

Barker et al.

[11] Patent Number: 4,850,829

[45] Date of Patent: Jul. 25, 1989

[54] TRANSMISSION PUMP WITH IMPROVED SEAL

[75] Inventors: Charles A. Barker; Barry L. Ladd, both of Indianapolis, Ind.

[73] Assignee: General Motors Corporation, Detroit, Mich.

[21] Appl. No.: 229,387

[22] Filed: Aug. 8, 1988

[51] Int. Cl.[4] ..... F04C 27/00

[52] U.S. Cl. ..... 418/15; 277/204; 418/149

[58] Field of Search ..... 277/203, 204; 418/15, 418/149

[56] References Cited

U.S. PATENT DOCUMENTS

| | | | |
|---|---|---|---|
| 2,948,229 | 8/1960 | Brundage | 418/15 |
| 2,969,744 | 1/1961 | Hoffer | 418/149 X |
| 3,295,262 | 1/1967 | Brown | 418/149 X |
| 4,516,784 | 5/1985 | Merz | 277/180 |
| 4,701,115 | 10/1987 | Shimizu et al. | 418/55 |

*Primary Examiner*—Michael Koczo

*Attorney, Agent, or Firm*—Patrick M. Griffin

[57] ABSTRACT

A transmission pump has a cylindrical body sized to fit in a bore in the transmission housing. Inlets and outlets are circumferentially spaced on the cylindrical body. Convoluted ring type seals are arranged on the outer surface of the body in order to allow the inlets and outlets to have profiles that are closer to or even axially overlap, allowing for greater size within a limited axial body length.

3 Claims, 2 Drawing Sheets

TRANSMISSION PUMP WITH IMPROVED SEAL

This invention was made with Government support under Contract No. DAAE07-84-C-R082 awarded by Department of Defense. The Government has certain rights in this invention.

BACKGROUND OF THE INVENTION

This invention relates to pumps and seals in general and specifically to a transmission pump with an improved seal configuration that allows the pump to have larger inlets and outlets within a given pump length.

Automatic transmissions have a housing that contains various clutches and valves that are operated by pressurized hydraulic fluid. The hydraulic fluid is circulated by a pump that picks up the hydraulic fluid at low pressure and returns it at a higher pressure. Typically, the pump has a drive shaft within a cylindrical steel body that is fitted into a generally matching bore in the transmission housing. A plurality of inlets and outlets open through the surface of the pump body, and register with various reservoirs and distribution channels in the transmission housing. It is necessary that these inlets and outlets be sealed relative to the reservoirs and channels with which they register, and that they be isolated from one another to prevent cross flow. Conventionally, the seals are simple, circular O ring type seals. The various inlets in the pump body are aligned and axially spaced from one another, as are the outlets. The inlets are circumferentially spaced from the outlets, generally being located on opposite sides of the pump body. While each inlet is axially adjacent to at least one outlet, and vice versa, the adjacent inlets and outlets have no axial overlap with one another. Therefore, as one moves around the surface of the pump body in a circle, the surface of the pump body in the areas between the various inlets and outlets are uninterrupted. These uninterrupted areas may be referred to as lands. Circular grooves are cut into the lands, each containing a seal.

When the pump body is inserted into the housing bore, the seals compress against the wall of the bore to provide the necessary sealing and prevent cross flow. A shortcoming of this design is the necessity that the lands be wide enough to machine the necessary seal grooves. That necessity limits the possible size of the inlets and outlets for a given length of pump body. This, in turn, limits the possible rate of flow into and out of the inlets and outlets, limiting pump capacity.

SUMMARY OF THE INVENTION

The invention provides a pump with a novel seal configuration that allows for larger inlet and outlet size for a given axial length.

The pump of the invention also has a generally cylindrical pump body that is inserted into a matching bore in a transmission housing. In the preferred embodiment, the pump body also has a line of three low pressure inlets and a line of three high pressure outlets, located on opposite sides of the pump body. Unlike the conventional configuration described above, however, the axially adjacent inlets and outlets are either very near one another in terms of relative axial position, or they may even have a significant axial overlap. This allows for a greater size, on average, for the inlets and outlets, but makes the conventional seal described above unworkable. That is, in moving around the surface of the pump body in a circle, the surface of the pump body in the areas between the various inlets and outlets would either be interrupted, or would be very narrow.

Sealing is accomplished by machining grooves into the pump body at least some of which are convoluted, rather than being circular. The grooves run axially all the way around the pump body surface, but jog axially back and forth so as to wind their way between the adjacent inlets and outlets and isolate them from one another. Seals that are generally circular in the free state are stretched into the grooves, and take on the same convoluted shape as the grooves. The pump body and seals together are then inserted into a comparable length bore in a transmission housing, compressing the seals against the bore wall. The relatively wide, uninterrupted lands of the conventional pump are not necessary, giving a more axially compact pump body for the inlet and outlet size.

It is, therefore, a general object of the invention to provide a pump body that is more compact, having a greater inlet and outlet size for a given pump body length.

It is another object of the invention to provide such a pump body in which an axially adjacent inlet and outlet are axially proximate to one another, but still sealed from one another, allowing one or both to be of greater size.

It is another object of the invention to seal and isolate the adjacent, axially proximate inlet and outlet from one another with a ring type seal that runs all the way around the pump body in a convoluted path between the inlet and outlet.

DESCRIPTION OF THE PREFERRED EMBODIMENT

These and other objects and features of the invention will appear from the following written description, and from the drawings, in which.

Figure 1:
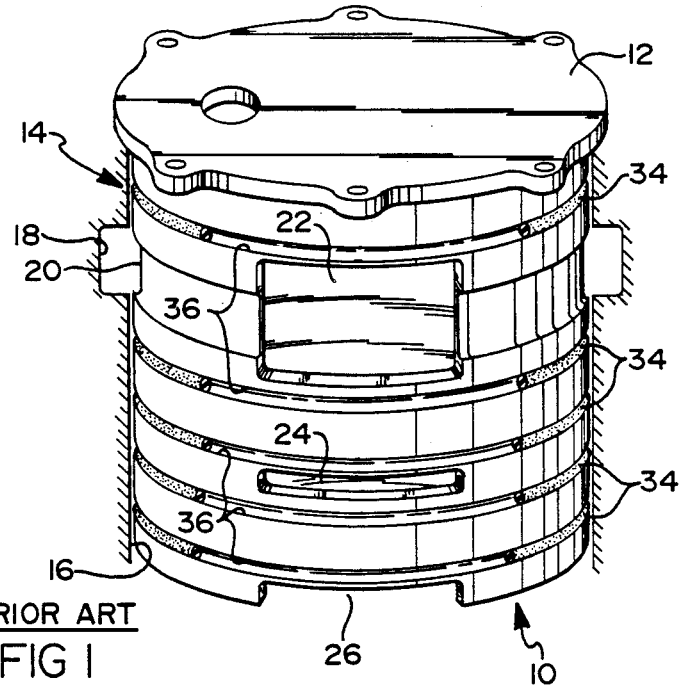
PRIOR ART FIG 1
FIG. 1 is a perspective view of the conventional pump body referred to above.
Figure 3:
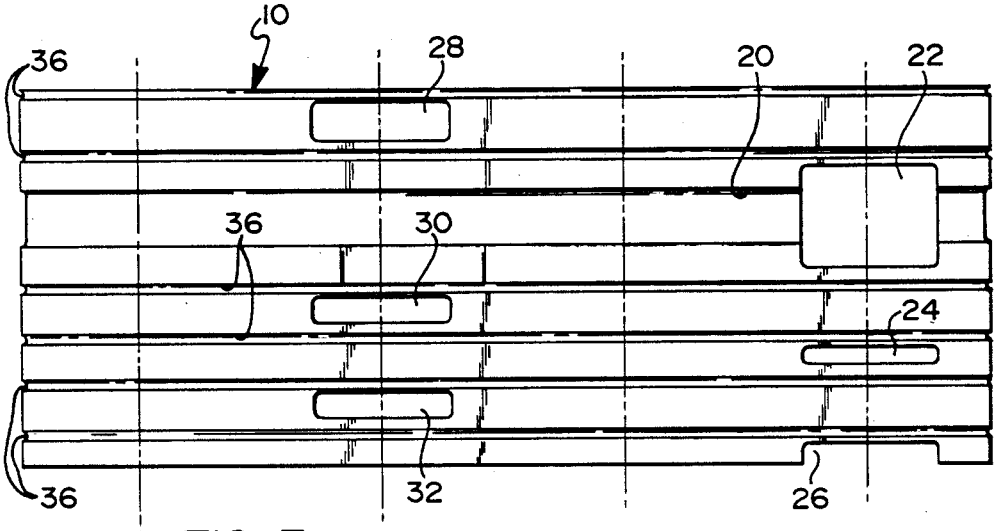
FIG 3 PRIOR ART
FIG. 3 is a rolled out view of the surface of the pump body of FIG. 1.

Referring first to FIGS. 1 and 3, the cyclindrical steel pump body of the conventional pump referred to above is indicated generally at 10. A pump shaft and pumping gears or vanes, not illustrated, would be located coaxially within pump body 10. A mounting flange 12 at the end of pump body 10 would be used to mount it to a transmission housing 14 within a bore 16. Bore 16 is basically cylindrical and smooth, but does have a relatively wide groove 18 that mates with a matching groove 20 in pump body 10 to create a collection reservoir for low pressure hydraulic fluid. Other reservoirs and distribution channels internal to housing 14 would also open into passage 16, but need not be specifically illustrated. There are three axially spaced aligned inlets, 22, 24 and 26 opening through pump body 10, as well as three axially spaced aligned outlets, 28, 30 and 32, which are only visible in FIG. 3. The axial locations of each of the inlets 22–26 is predetermined so as to register with a respective reservoir, as is each of the outlets 28–32 so as to register with a respective distribution channel. Inlet 22, for example, registers with the reservoir described above. The inlets 22–26 receive fluid at low pressure, while the outlets 28–32 each return it at higher pressure to power the transmission. The inlets and outlets 22–26 and 28–32 are each sealed with simple circular O ring type seals 34. Seals 34 are incorporated into pump body 10 in a fashion described next.

Referring next to FIG. 3, the relative position and size of the various inlets and outlets may be seen all at once and better understood if the surface of pump body 10 is rolled out. The inlets 22–24 and outlets 28–32 must be circumferentially separate from one another, and they are in fact on opposite sides of pump body 10. The larger any inlet or outlet opening is, the more potential capacity it has to handle fluid. However, there is a limited surface area of pump body 10 available within a given length pump body 10 through which to cut openings. Beyond that inevitable limitation on opening size, however, the way in which seals 34 are configured and incorporated into pump body 10 creates an additional limitation on opening size. Seals 34 fit into simple circular seal grooves 36, all of which are identical in size and shape. In order to have enough uninterrupted surface area of pump body 10 available in which to machine the grooves 36, relatively wide lands must be left axially between each inlet, such as between inlet 22 and either of its axially adjacent outlets, 28 or 30. This dictates a configuration in which the profile of no inlet can overlap axially with either adjacent outlet, or vice versa. In fact, in order to provide the necessary machining lands, the adjacent outlets and inlets cannot be axially proximate to one another, but must be staggered as shown.

Figure 2:
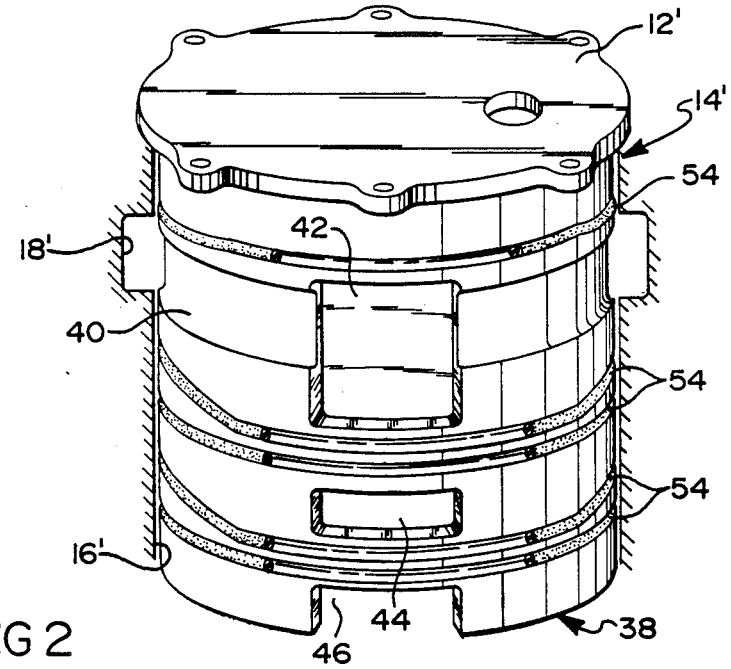
FIG. 2 is a perspective view of a preferred embodiment of the pump body of the invention.
Figure 4:
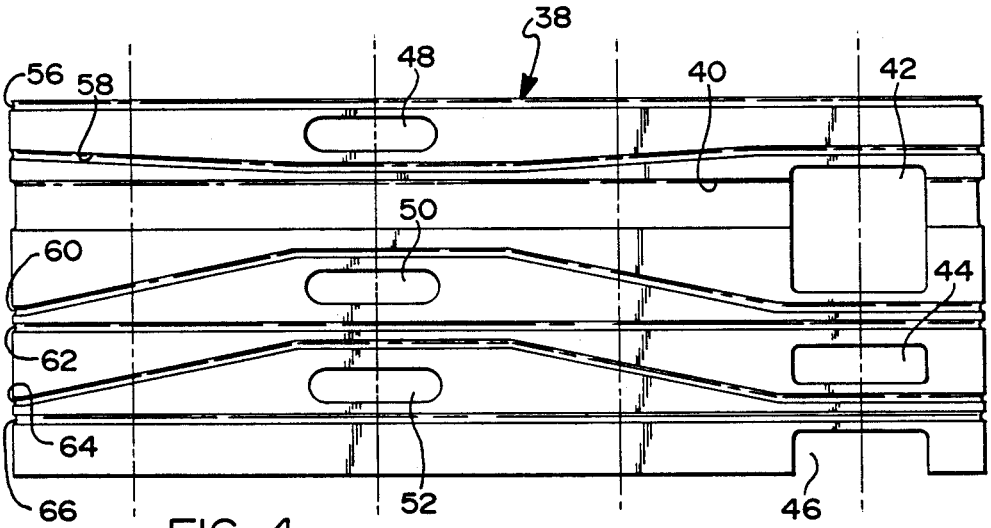
FIG. 4 is a rolled out view of the surface of the pump body of FIG. 2.

Referring next to FIGS. 2 and 4, the pump body of the invention, indicated generally at 38, does not present the same limitation on inlet and outlet size. Pump body 38 has the same axial length as pump body 10, and fits into basically the same transmission housing bore, indicated at 16'. A wide groove 40 in body 38 mates with a matching groove 18' to create a similar reservoir. Pump body 38 also has a line of three inlets, 42–46, and three diametrically opposed outlets, 48–52, which correspond in general location to those in pump body 10, with similar circumferential length. However, in general, every inlet or outlet in pump body 38 is axially wider than the corresponding inlet or outlet in pump body 10. This is true in every particular case, except for the outlets 28 and 48. However, the total axial width of both the outlets and inlets in pump body 38 is significantly greater than for pump body 10. Therefore, there is more available inlet and outlet area and consequently greater potential pump capacity. Sealing of the inlets and outlets, as with pump body 10, is provided by O ring type seals 54. However, seals 54 have a novel configuration, described next.

Referring next to FIG. 4, it will be noted that the inlets 42–46 and adjacent outlets 48–52 in pump body 38 are axially proximate to one another. In fact, some have a significant axial overlap, such as inlet 42 and adjacent outlet 50. By axial overlap, of course, it is not meant that the inlets and outlets physically overlap, only that their profiles occupy proximate or overlapping locations on the pump body 38. This axial proximity of adjacent inlets and outlets allows for the greater overall opening size and improved pump capacity, but also eliminates the uninterrupted seal land areas of pump body 10. Pump body 38 also has six sealing grooves machined therein, indicated at 56–66. Instead of being all circular, however, some of them, specifically 58, 60 and 64, are convoluted. A specific example is groove 60. It runs straight past the lower edge of inlet 42, then jogs axially up to run past outlet 50, then back down to complete its path around the pump body 38. Thus, inlet 42 and outlet 50 are entirely isolated from one another, despite their significant axial overlap. Sealing groove 64 follows a similar sinuous path between inlet 44 and adjacent outlet 52. Groove 58 runs similarly between inlet 42 and outlet 48, but need not shift axially to the same degree, because 42 and 48 are not as close. Groove 56 is just circular, because it is at the top end of pump body 38. Grooves 62 and 66 are simply circular because the adjacent inlets and outlets that they separate, namely 44 and 50, and 46 and 52, respectively, are not that close and do not overlap, although they conceivably could. No seal is necessary below inlet 46, since it opens right through the lower end of pump body 38 and would seat against the end wall of bore 16'. Every inlet and outlet is circumferentially bounded by a pair of sealing grooves. For example, outlet 50 is bordered by groove 60 and 62. And every adjacent inlet and outlet is entirely axially isolated from every adjacent outlet and inlet so as to prevent cross flow. For example, outlet 50 is axially isolated from adjacent inlet 42 by groove 60, and from inlet 44 by groove 62.

Referring again to FIG. 2, seals 54, while circular in their free state, are stretched into and take the shape of the various sealing grooves 56–66. So, the inlets 42–46 and outlets 48–52 are likewise bordered by and mutually isolated by the seals 54. The pump body 38 and seals 54 together are then inserted as a unit into bore 16', which puts the seals 54 close to or in compression with the wall of bore 16', creating the actual sealing contact. Seals 54 may be made of a material that swells when contacted by oil, so as to allow them to be pushed in easily, tightening their sealing contact later as they swell. Each inlet and outlet will thus be sealed relative to its respective reservoir or distribution channel by virtue of being bordered by seals 54. Cross flow from outlet to adjacent inlet will be prevented by virtue of their mutual axial isolation. So, pump body 38 is more compact in that it provides greater inlet and outlet size and consequently greater pump potential within the same axial space envelope in housing 14'.

Variations of the preferred embodiment 38 are possible. As few as one inlet and adjacent outlet, and one convoluted seal could be used, although that would be a rare case. Other means could be used to hold the seals in the convoluted pattern shown, although grooves will generally be most practical. A pump body with the same inlet and outlet size, but of shorter axial length, would also be a possibility. Therefore, it will be understood that it is not intended to limit the invention to just the preferred embodiment disclosed.

The embodiments of the invention in which an exclusive property or privilege is claimed are defined as follows:

1. A pump of the type that receives fluid at a low pressure and returns it at a higher pressure, and which is inserted into a generally generally cylindrical bore in a housing, comprising, a generally cylindrical pump body sized so as to fit closely within said housing bore, at least one fluid inlet opening through the surface of said pump body at a predetermined axial position on said pump body to receive said fluid at low pressure, at least one fluid outlet to return said fluid at high pressure, said outlet opening through the surface of said pump body at a location circumferentially spaced from said inlet, but axially proximate to the predetermined axial position of said inlet, and, a ring type seal running generally circumferentially around the surface of said pump body and axially between said inlet and outlet in a convoluted path so as to isolate said inlet and outlet from one another despite their axial proximity, thereby giving an axially compact pump.

2. A pump of the type that receives fluid at a low pressure and returns it at a higher pressure, and which is inserted into a generally cylindrical bore in a housing, comprising, a generally cylindrical pump body sized so as to fit closely within said housing bore, a plurality of fluid inlets opening through the surface of said pump body at predetermined axial positions on said pump body to receive said fluid at low pressure, a matching plurality of fluid outlets to return said fluid at high pressure, one respective to each inlet, said outlets opening through the surface of said pump body at locations circumferentially spaced from said inlet to, but axially proximate to the predetermined axial positions of said inlets, and, a plurality of ring type seals running generally circumferentially around the surface of said pump body and axially between each pairof respective inlets and outlets in a convoluted path so as to isolate said respective pairs of inlets and outlets from one another despite their axial proximity to one another, thereby giving an axially compact pump.

3. An improved pump of the type that receives fluid at a low pressure and returns it at a higher pressure, and which has a generally cylindrical pump body that is inserted into a generally cylindrical bore in a housing with at least one low pressure inlet and one axially adjacent high pressure outlet opening through the surface of said pump body at circumferentially spaced locations, the improvement comprising, ring type seal running generally circumferentially around the surface of said pump body and axially between said inlet and outlet in a convoluted path so as to isolate said inlet and outlet from one another while allowing said inlet and outlet to be axially proximate to one another, thereby giving a pump of greater axial compactness for the same inlet and outlet size.

* * * * *